United States Patent [19]

Chin et al.

[11] 4,311,537

[45] Jan. 19, 1982

[54] LOW-COBALT FE-CR-CO PERMANENT MAGNET ALLOY PROCESSING

[75] Inventors: Gilbert Y. Chin, Berkeley Heights; Martin L. Green; Richard C. Sherwood, both of New Providence; Jack H. Wernick, Madison, all of N.J.

[73] Assignee: Bell Telephone Laboratories, Incorporated, Murray Hill, N.J.

[21] Appl. No.: 142,633

[22] Filed: Apr. 22, 1980

[51] Int. Cl.[3] ..... C21D 1/04

[52] U.S. Cl. ..... 148/108; 148/31.57; 148/120; 148/121

[58] Field of Search ..... 148/102, 103, 108, 120, 148/121, 31.55, 31.57

[56] References Cited

U.S. PATENT DOCUMENTS

| | | | |
|---|---|---|---|
| 2,506,624 | 5/1950 | Wirsching | 179/120 |
| 3,806,336 | 4/1974 | Kaneko et al. | 75/122 |
| 3,954,519 | 5/1976 | Inoue | 148/121 |
| 3,989,556 | 11/1976 | Iwata et al. | 148/121 |
| 4,075,437 | 2/1978 | Chin et al. | 179/114 R |
| 4,093,477 | 6/1978 | Iwata et al. | 148/31.57 |
| 4,120,704 | 10/1978 | Anderson | 148/103 |
| 4,174,983 | 11/1979 | Chin et al. | 148/102 |

*Primary Examiner*—L. Dewayne Rutledge
*Assistant Examiner*—John P. Sheehan
*Attorney, Agent, or Firm*—Peter A. Businger

[57] ABSTRACT

In view of rising cobalt costs, low-cobalt alloys such as, e.g., Fe-Cr-Co alloys are finding increasing use in the manufacture of permanent magnets. Desired magnetic energy product of such magnets is typically at least 1 million gauss-oersted.

In the interest of maximizing magnetic energy product per unit weight cobalt, low-cobalt Fe-Cr-Co alloys are processed by solidifying a bulk object from a melt, annealing, quenching, and aging by cooling at rates in a range of 0.1 to 2 degrees C. per hour in a magnetic field. Cold working prior to aging may be used to further enhance magnetic energy product.

Resulting magnets have optimized maximum magnetic energy product $(BH)_{max}$ per unit weight cobalt comprised in an alloy.

8 Claims, 1 Drawing Figure

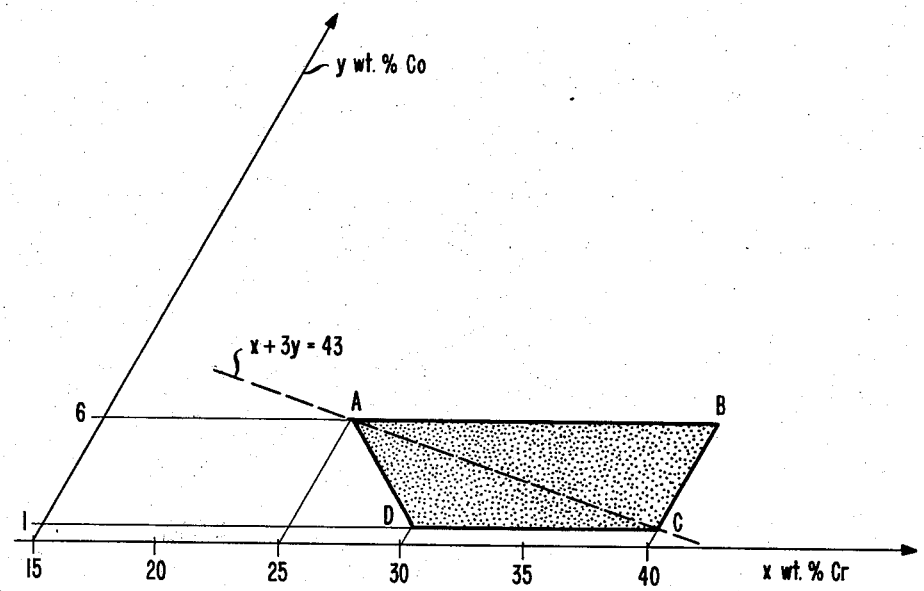
y wt. % Co
x + 3y = 43
6
A
B
1
D
C
15
20
25
30
35
40
x wt. % Cr

LOW-COBALT FE-CR-CO PERMANENT MAGNET ALLOY PROCESSING

TECHNICAL FIELD

The invention is concerned with magnetic materials.

BACKGROUND OF THE INVENTION

Magnetic materials suitable for use in relays, ringers, and electro-acoustic transducers such as loudspeakers and telephone receivers characteristically exhibit high values of magnetic coercivity, remanence, and energy product. Among alloys exhibiting such desirable properties are Al-Ni-Co-Fe and Mo-Co-Fe alloys as mentioned, e.g., in U.S. Pat. No. 2,506,624, issued May 9, 1950 to R. E. Wirsching. More recently, alloys comprising Fe, Cr, and Co have been investigated with regard to potential suitability in the manufacture of permanent magnets. Specifically, U.S. Pat. No. 3,806,336, issued Apr. 23, 1974 to H. Kaneko et al., discloses high-cobalt ternary Fe-Cr-Co alloys. Quaternary alloys comprising elements such as, e.g., Nb or Ta in addition to Fe, Cr, and Co are disclosed in U.S. Pat. No. 3,954,519, issued May 4, 1976 to K. Inoue; alloys comprising fourth elements Zr, Mo, Nb, V, Ti, or Al are disclosed in U.S. Pat. No. 4,075,437, issued Feb. 21, 1978 to G. Y. Chin et al.; and lower-cobalt ternary alloys are disclosed in a U.S. patent application by S. Jin, Ser. No. 92,941, filed Nov. 9, 1979 now U.S. Pat. No. 4,253,883.

Powder metallurgy processing of Fe-Cr-Co magnets is disclosed in a U.S. patent application by M. L. Green and R. C. Sherwood, Ser. No. 123,691, filed Feb. 22, 1980.

Magnets are typically mass produced; as a result, final cost is largely determined by cost of raw materials. And, since cobalt has become increasingly expensive as a constituent in Fe-Cr-Co alloys, final cost is strongly dependent on amount of cobalt.

SUMMARY OF THE INVENTION

Magnetic properties such as, in particular, a maximum energy product of at least 1 million gauss-oersted are developed in alloys comprising Fe, Cr, and Co in a preferred amount of at least 90 weight percent of a metallic body. Relative to the combined amount of Fe, Cr, and Co, weight percents are preferably limited such that Cr is in a range of 25–40 weight percent, Co in a range of 1–6 weight percent, and such that the sum of weight percent Cr and weight percent Co is at least 31 weight percent.

Processing comprises solidifying a bulk object from a melt, magnetic aging by controlled cooling from a temperature which is close to or preferably at or above a spinodal temperature, cooling being at least partially in a magnetic field. Preferred cooling rate is directly dependent on Cr and Co contents of an alloy and is less than or equal to 2 degrees C. per hour and greater than or equal to 0.1 degrees C. per hour. Such processing is optimized so as to approximately maximize a quantity, here designated as cobalt utilization efficiency, which is defined as the ratio of maximum magnetic energy product of an alloy to unit weight cobalt comprised in the alloy.

Magnets may be readily formed, e.g., by cold shaping prior to magnetic aging; cold deformation prior to magnetic aging further results in enhanced magnetic properties.

BRIEF DESCRIPTION OF THE DRAWING

The FIGURE is a diagram of compositions of alloys of the invention.

DETAILED DESCRIPTION

Alloys are prepared by solidifying a bulk object from a melt, e.g., by casting of constituent elements Fe, Cr, and Co or their alloys in a crucible or furnace such as, e.g., an induction furnace. Preferred compositions comprise at least 90 weight percent and preferably at least 95 weight percent Fe, Cr, and Co. Relative to the combined amount of Fe, Cr, and Co, weight percents are preferably limited such that Cr is in a range of 25–40 weight percent, Co is in a range of 1–6 weight percent, and such that the sum of weight percent Cr and weight percent Co amounts to at least 31 weight percent. Such compositions correspond to points within and on the boundary of a quadrilateral which has vertices A, B, C, and D as shown in the FIGURE.

In the interest of simplicity of composition, alloys may be essentially ternary Fe-Cr-Co alloys. Or, in the interest of minimizing raw material costs, Co may be restricted to less than 3 weight percent or less than or equal to 2.5 weight percent.

Preparation of an alloy and, in particular, preparation by casting from a melt calls for care to guard against inclusion of excessive amounts of certain impurities as may originate from raw materials, from the furnace, or from the atmosphere above a melt. To minimize oxidation or excessive inclusion of nitrogen, it is desirable to prepare a melt with slag protection, in a vacuum, or in an inert atmosphere such as, e.g., an argon atmosphere. Levels of specific impurities are preferably kept below 0.05 weight percent N, 0.5 weight percent Mg, 0.05 weight percent S, and 0.05 weight percent O. Inclusion of certain other extraneous elements such as, e.g., Si, Ti, Nb, Ta, Zr, Mo, V, or Al is considered to be harmless in the sense that their presence merely results in a dilution of magnetic moment.

Typical processing of a body of the alloy after casting is as follows: In order to homogenize composition, the alloy is soaked by heating, generally at a temperature which is in a range of 1100 to 1400 degrees C. for 1 to 48 hours depending on size of the body of the alloy. Soaking may be in combination with hot working and may be performed in air or, in the interest of minimizing surface oxidation, under exclusion of oxygen.

The soaking treatment is terminated by rapid cooling, e.g., by water quenching. In the case of articles such as, e.g., thin strips, air cooling may be sufficient.

At a temperature which typically does not exceed 300 degrees C., the alloy may then be cold formed, e.g., by bending, wire drawing, deep drawing, rolling, or swaging. Forming may be carried out in stages with intermediate additional heat treatment at a temperature above the recrystallization temperature and typically above 700 degrees C., followed by quenching.

Deformation such as, e.g., by drawing, rolling, or swaging is additionally beneficial in the interest of ultimate magnetic properties of an aged magnet. Preferred deformation results in area reduction greater than or equal to 40 percent and preferably greater than or equal to 70 percent. In the interest of realizing full benefit from such deformation, subsequent heating to aging temperature is limited to temperatures below the recrystallization temperature.

Additional processing steps such as, e.g., machining by drilling, turning, or milling before or after forming are not precluded.

The alloy is finally subjected to an aging heat treatment for magnetic hardening. According to the invention, such treatment comprises controlled cooling from a first temperature which preferably is at or above a spinodal temperature. A first temperature slightly below the spinodal temperature may be acceptable if such temperature is within approximately 50 or, more typically, within approximately 15 degrees C. of the spinodal temperature.

Cooling is in a magnetic field for at least a portion of the cooling period and, in particular, for an initial portion of such period. Field strength is sufficient to substantially magnetize an alloy and is preferably greater than or equal to 100 or, more typically, greater than or equal to 500 oersted.

In the interest of desirable magnetic properties and, in particular, in the interest of maximizing energy product, lowering of temperature is such that over essentially the entire range of temperatures between the first temperature and a second temperature, rate of temperature change is in a range whose limits depend on Co and Cr contents of an alloy. Specifically, if Cr is 40 weight percent and Co is 6 weight percent, cooling rate is in a preferred range of 0.3 to 2 degrees C. per hour. Or, if Cr is 40 weight percent and Co is 1 weight percent, cooling rate is in a preferred range of 0.1 to 1 degree C. per hour. The same preferred range of 0.1 to 1 degree C. per hour applies when Cr is 25 weight percent and Co is 6 weight percent. Preferred upper and lower limits on cooling rates at different combinations of Cr and Co may be conveniently obtained as follows: If x and y denote, respectively, weight per Cr and weight per Co of an alloy of the invention, and if the value of the algebraic expression $x+3y$ is greater than or equal to 43, then a preferred approximate upper limit, here designated U, and a preferred approximate lower limit, here designated L, on cooling rate for the alloy comprising x weight percent Cr and y weight percent Co may be obtained according to the formulas $U=0.067x+0.2y-1.88$, and $L=0.013x+0.04y-0.47$. These formulas may be justified by linear interpolation between, respectively, preferred upper and lower limits given above for three specific (x, y)-combinations (40, 6), (40, 1), and (25, 6) as represented in the FIGURE by points A, B, and C, respectively. If, on the other hand, the value of the expression $x+3y$ is less than 43, then preferred upper and lower limits are, respectively, 1 and 0.1 degrees C. per hour, i.e., the same as those stated above for (x, y)-combinations (40, 1) and (25, 6).

During controlled cooling, temperature may decrease linearly, exponentially, or according to a schedule which approximates linear or exponential temperature decrease such as, e.g., by a sequence of decreasing isothermal steps. Controlled cooling continues until a second temperature is reached below which further enhancement of magnetic properties is practically negligible. A temperature of approximately 500 degrees C. may be typical for such second temperature, and no particular care is required during further cooling to room temperature.

Processing of low-cobalt Fe-Cr-Co alloys as described above yields magnets having a coercive force which is greater than or equal to 150 oersted and a maximum energy product which is greater than or equal to 1 million gauss-oersted. While useful isotropic magnets having maximum magnetic energy product greater than or equal to 1 million gauss-oersted can be obtained in low-cobalt Fe-Cr-Co alloys by slow cooling in the absence of a magnetic field, processing in a magnetic field according to the invention is further optimized in the sense that magnetic energy product is approximately maximized per unit weight cobalt.

Maximized quantity, here designated as cobalt utilization efficiency, is defined as the ratio of maximum magnetic energy product of an alloy to unit weight cobalt comprised in the alloy, conveniently normalized such that a value of 1 is obtained for a prior art alloy Alnico 5. Maximization is illustrated by numerical values shown in Table 1 for Examples 1 to 9 of the invention and for five prior art alloys. In particular, it can be seen from Table 1 that alloys of the invention have cobalt utilization efficiency greater than 3.

EXAMPLE 1

An Fe-33Cr-2Co-1Hf alloy was arc-cast into ingot form, homogenized at a temperature of 1310 degrees C. for 48 hours, and quenched into ice water. A cylindrical sample having a length of approximately 15 mm and a diameter of approximately 8 mm was prepared by precision turning. The sample was heated to a temperature of 700 degrees C., kept at this temperature for 15 minutes, furnace cooled to a temperature of 625 degrees C., and cooled at a rate of 0.4 degrees C. per hour to a temperature of 500 degrees C. During cooling a 1250 oersted magnetic field was provided, parallel to the axis of the sample, by a water-cooled copper solenoid. To minimize flux leakage, the sample was placed between two iron cylinders inside the furnace.

After cooling to room temperature, hysteresis loop B/H was measured by means of a hysteresograph. Measured values of magnetic remanence, coercive force, and maximum magnetic energy product were, respectively, $B_r=12{,}500$ gauss, $H_c=203$ oersted, and $(BH)_{max}=1.76$ million gauss-oersted.

EXAMPLE 2

An Fe-30Cr-5Co-0.8Ge alloy sample was prepared and processed as described in Example 1, except that cooling was at a rate of 0.9 degrees C. per hour. Measured values were $B_r=13{,}200$ gauss, $H_c=531$ oersted, and $(BH)_{max}=4.93$ million gauss-oersted.

EXAMPLE 3

An Fe-30Cr-5Co-0.1C alloy sample was prepared and processed as described above in Example 1, except that cooling was at a rate of 0.9 degrees C. per hour. Measured properties $B_r=13{,}100$ gauss, $H_c=537$ oersted, and $(BH)_{max}=4.89$ million gauss-oersted.

EXAMPLE 4

An Fe-30Cr-5Co-0.25Ti alloy sample was prepared and processed as described above in Example 1, except that cooling was at a rate of 0.9 degrees C. per hour. Measured properties were $B_r=13{,}400$ gauss, $H_c=534$ oersted, and $(BH)_{max}=5.07$ million gauss-oersted.

EXAMPLE 5

An Fe-30Cr-5Co-0.1B alloy sample was prepared and rocessed as described above in Example 1, except that cooling was at a rate of 0.9 degrees C. per hour. Measured properties were $B_r=13{,}100$ gauss, $H_c=525$ oersted, and $(BH)_{max}=5.07$ million gauss-oersted.

EXAMPLE 6

An Fe-30Cr-5Co-0.5Hf alloy sample was prepared and processed as described above in Example 1, except that cooling was at a rate of 0.9 degrees C. per hour. Measured properties were $B_r$=12,900 gauss, $H_c$=549 oersted, and $(BH)_{max}$=5.22 million gauss-oersted.

EXAMPLE 7

An Fe-30Cr-5Co alloy sample was prepared and processed as described above in Example 1, except that cooling was at a rate of 0.9 degrees C. per hour. Measured properties were $B_r$=13,300 gauss, $H_c$=528 oersted, and $(BH)_{max}$=5.31 million gauss-oersted.

EXAMPLE 8

An Fe-30Cr-5Co alloy was arc-cast into ingot form, homogenized at a temperature of 1310 degrees C. for 48 hours, and quenched into ice water. The resulting sample was rolled at room temperature so as to result in 97.2 percent area reduction, heated to a temperature of 650 degrees C., kept at this temperature for 15 minutes, furnace cooled to a temperature of 625 degrees C., and cooled at a rate of 0.9 degrees C. per hour in a 1250 oersted magnetic field. Measured properties were $B_r$=12,600 gauss, $H_c$=596 oersted, and $(BH)_{max}$=5.7 million gauss-oersted.

EXAMPLE 9

An Fe-32Cr-3Co alloy sample was prepared and processed as described above in Example 1, except that cooling was at a rate of 0.4 degrees C. per hour. Measured properties were $B_r$=12,900 gauss, $H_c$=449 oersted, and $(BH)_{max}$=4.08 million gauss-oersted.

TABLE 1

| Alloy | Co w % | $(BH)_{max}$ MGOe | Cobalt Utilization Efficiency |
|---|---|---|---|
| Alnico 5 | 24 | 5.5 | 1.0 |
| Alnico 9 | 35 | 9.0 | 1.1 |
| $SmCo_5$ | 63 | 18.0 | 1.3 |
| 11.5 Co-33Cr-Fe | 11.5 | 6.3 | 2.4 |
| $Sm_2(Co,Cu,Fe)_{17}$ | 50 | 30.0 | 2.7 |
| Example 1 | 2 | 1.76 | 3.8 |
| Example 2 | 5 | 4.93 | 4.3 |
| Example 3 | 5 | 4.89 | 4.3 |
| Example 4 | 5 | 5.07 | 4.4 |
| Example 5 | 5 | 5.07 | 4.4 |
| Example 6 | 5 | 5.22 | 4.6 |
| Example 7 | 5 | 5.31 | 4.7 |
| Example 8 | 5 | 5.70 | 5.9 |
| Example 9 | 3 | 4.08 | 6.0 |

We claim:

1. Method for producing a magnetic article comprising a body of an alloy which comprises Fe, Cr, and Co in a combined amount of at least 90 weight percent of said body, which comprises Cr in an amount in the range of 25–40 weight percent of said combined amount, which comprises Co in an amount in the range of 1–6 weight percent of said combined amount, in which weight percent Cr plus weight percent Co is greater than or equal to 31, and in which weight percent Cr plus three times weight Co is less than or equal to 43, said method comprising solidifying a bulk object from a melt of said alloy, annealing, rapid cooling, and aging, said method being CHARACTERIZED IN THAT aging comprises lowering of temperature from a first temperature to a second temperature, said first temperature being greater than a temperature which is 50 degrees C. less than a spinodal temperature, said second temperature being less than or equal to 500 degrees C. and said second temperature further being such that magnetic properties are essentially fully enhanced upon lowering of temperature to said second temperature, lowering of temperature being such that over essentially the entire range of temperatures between said first temperature and said second temperature, rate of temperature change is in a range of 0.1 to 1 degree C. per hour when weight percent Cr, here designated as x and weight percent Co, here designated as y, are such that $x+3y$ is less than 43, and in which said rate is in a range whose lower limit is $0.013x+0.04y-0.47$, and whose upper limit is $0.067x+0.2y-1.88$ when $x+3y$ is equal to 43, said body being in a magnetic field which is sufficient to substantially magnetize said body for at least an initial period in which temperature is lowered, whereby said body has a coercive force which is greater than or equal to 150 oersted, a maximum energy product which is greater than or equal to 1 million gaussoersted, and an Alnico-5-normalized ratio of maximum magnetic energy product to unit weight Co comprised in said alloy which is greater than 3.

2. Method of claim 1 in which said combined amount is at least 95 weight percent of said body.

3. Method of claim 1 in which said combined amount is essentially 100 weight percent of said body.

4. Method of claim 1 in which Co is comprised in said alloy in an amount which is less than 3 weight percent of said combined amount.

5. Method of claim 1 in which said body, prior to heating to said first temperature, is plastically deformed, resulting in area reduction greater than or equal to 40 percent.

6. Method of claim 5 in which area reduction is greater than or equal to 90 percent.

7. Method of claim 1 in which said first temperature is greater than or equal to 625 degrees C.

8. Article of manufacture comprising a magnetic article made by the method of claim 1, said alloy comprising cobalt in an amount which is less than 3 weight percent of said combined amount.

* * * * *